US005096148A

United States Patent [19]

Quellais et al.

[11] Patent Number: 5,096,148

[45] Date of Patent: Mar. 17, 1992

[54] GOLF BAG STAND

[75] Inventors: Jacques Quellais, Saint Jorioz; Bertrand Gautherot, Cran-Gevrier, both of France

[73] Assignee: Salomon S.A., Annecy Cedex, France

[21] Appl. No.: 596,006

[22] Filed: Oct. 11, 1990

[30] Foreign Application Priority Data

Oct. 25, 1989 [FR] France ..... 89 14332

[51] Int. Cl.[5] ..... A63B 55/00

[52] U.S. Cl. ..... 248/96; 206/315.7; 248/688

[58] Field of Search ..... 248/96, 688, 677, 188.4, 248/918, 923; 206/315.7

[56] References Cited

U.S. PATENT DOCUMENTS

| | | | |
|---|---|---|---|
| 1,738,242 | 12/1929 | Gunther | 248/96 |
| 1,799,835 | 4/1931 | Wise | 248/96 |
| 1,887,838 | 11/1932 | Gunther . | |
| 1,895,454 | 1/1933 | Ducat . | |
| 2,476,718 | 7/1949 | Foley | 248/96 |
| 2,571,088 | 10/1951 | Walton | 248/96 |
| 2,749,089 | 6/1956 | Feay et al. . | |
| 3,195,844 | 7/1965 | Roepke | 248/96 |
| 4,087,068 | 5/1978 | Gardner | 248/96 |
| 4,226,389 | 10/1980 | Neth | 248/96 |
| 4,798,357 | 1/1989 | Cho | 248/96 |
| 4,921,192 | 5/1990 | Jones | 248/96 |

FOREIGN PATENT DOCUMENTS

| | | |
|---|---|---|
| 627359 | 8/1949 | United Kingdom . |
| 635317 | 4/1950 | United Kingdom . |
| 677333 | 8/1952 | United Kingdom . |
| 2023413 | 1/1980 | United Kingdom . |

*Primary Examiner*—David L. Talbott

*Attorney, Agent, or Firm*—Sandler, Greenblum & Bernstein

[57] ABSTRACT

A stand having retractable legs for a golf bag comprising an upper assembly constituted by the head of the bag, a base affixed to this head, two legs, each journalled on the base around an axis so as to be movable between two positions; a retracted rest position and a deployed position, and an elastic system for maintaining the legs in the retracted position and in the deployed position, the elastic system being constituted by a support element acting on a deformable element affixed to the golf bag.

27 Claims, 6 Drawing Sheets

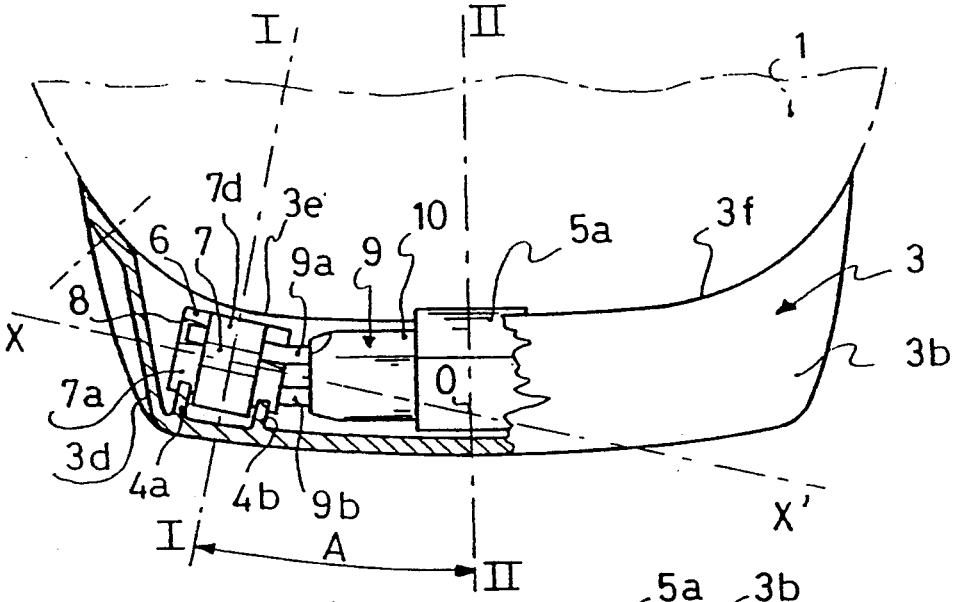
FIG: 3
FIG: 4
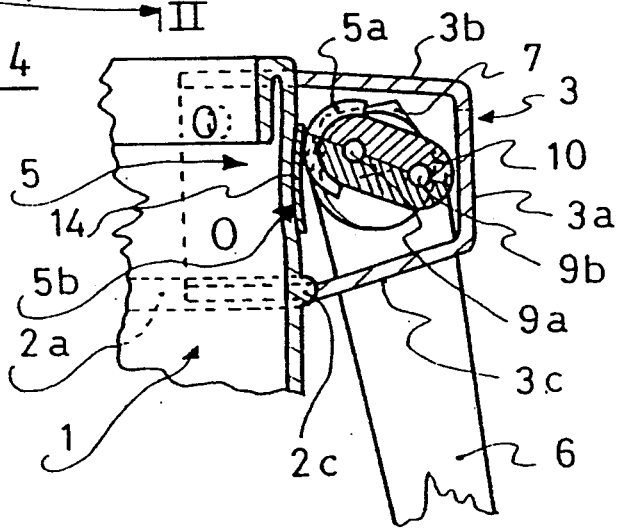
FIG: 4a
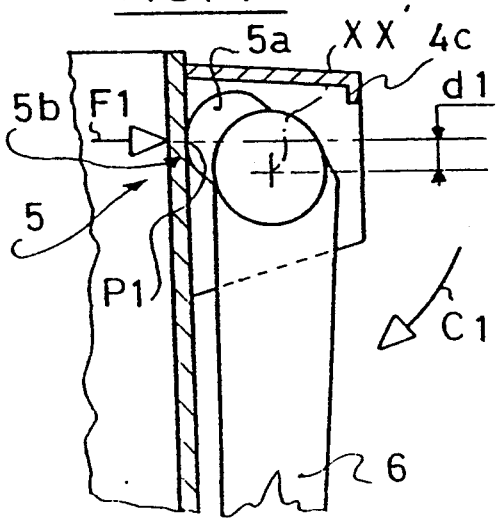
FIG: 4b
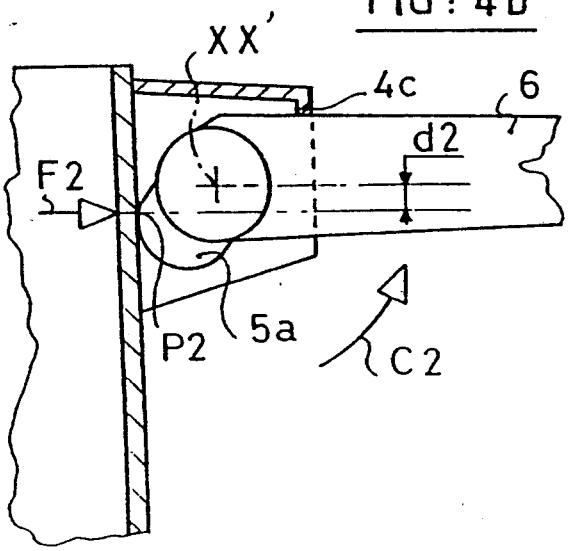

FIG: 4c
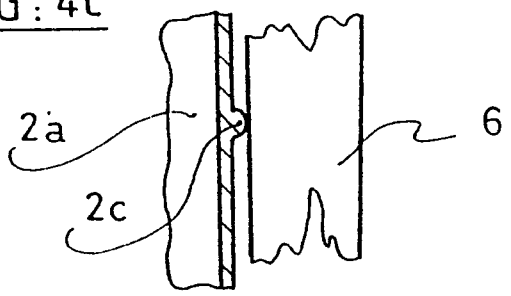
FIG: 5
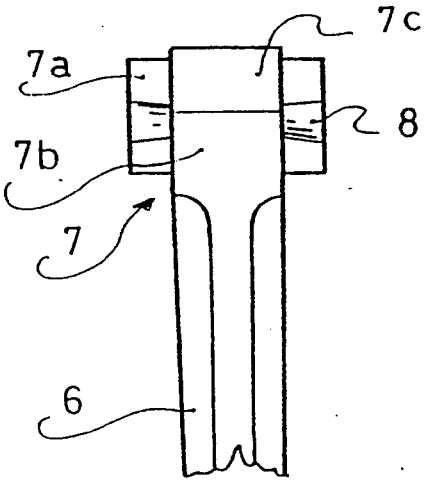
FIG: 6
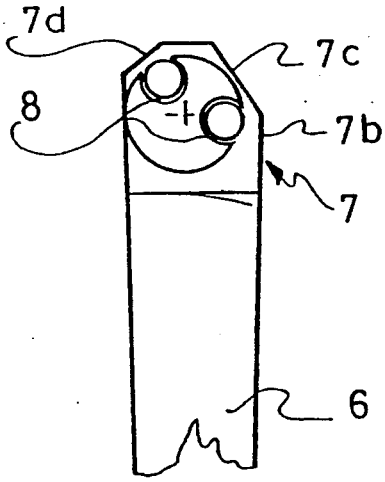
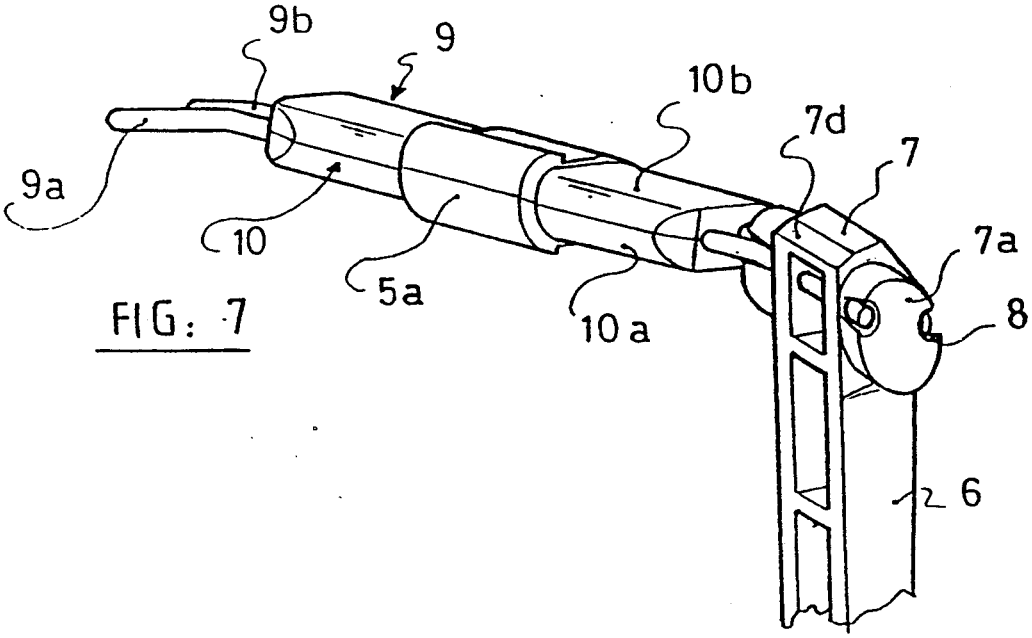
FIG: 7

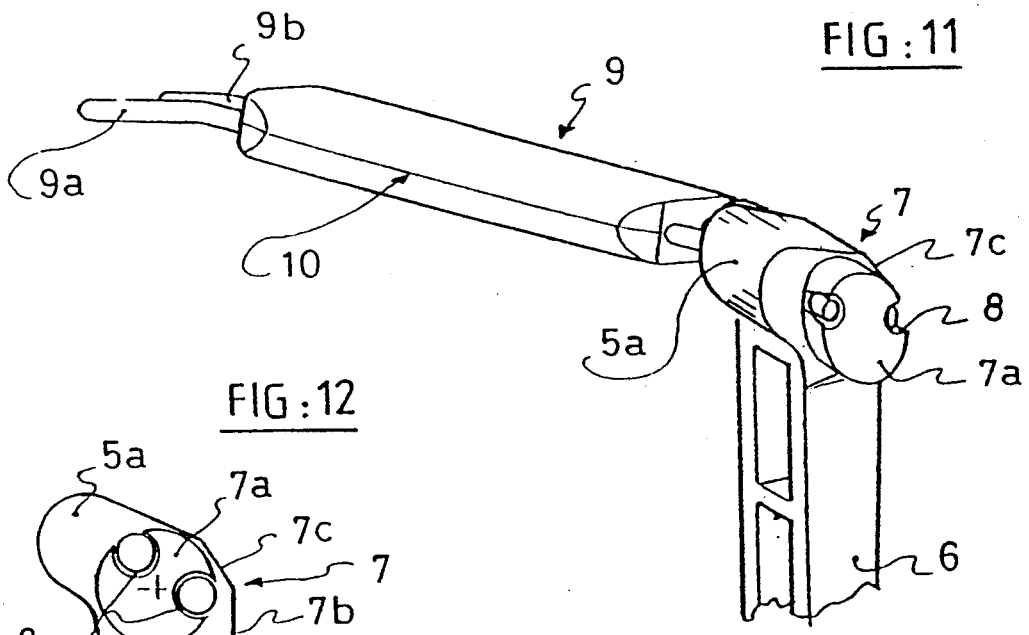
FIG: 11
FIG: 12
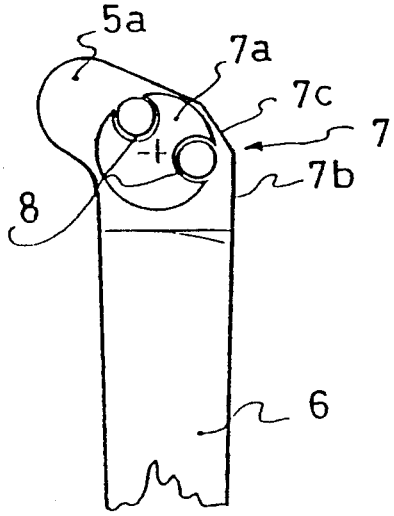
FIG: 13
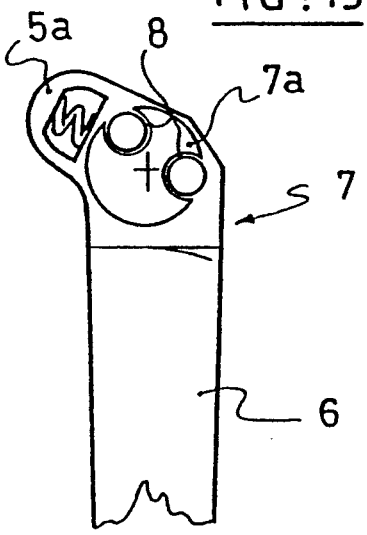

GOLF BAG STAND

BACKGROUND OF THE INVENTION

1. Field of the Invention

The present invention relates to a stand having retractable legs for a golf bag as well as a golf bag equipped with such a stand.

2. Description of Background and Relevant Information

Golf bags in which the various golf clubs are arranged and which are used in golfing are often provided at their upper end with a foldable stand comprising two retractable journalled legs which are normally pressed against the top of the bag, when the bag is being carried, and which can be deployed, with the legs diverging with respect to one another so as to form a V support on the ground. As a result, when the stand of the bag is deployed, the bag can be positioned in the inclined position on the ground on which it rests at three points, namely a rearward support point for the bottom of the bag and two front support points corresponding to the ends of the two deployed legs of the stand. As a result, the opening of the bag through which the heads of the various clubs extend, is spaced from the ground and one thus avoids the heads of the clubs contacting the ground and becoming soiled.

Amongst various stands having retractable legs for a golf bag which are known, those which are described in U.S. Pat. Nos. 1,887,838 and 2,749,089 each comprise two legs which are separately journalled, around individual axes, on the base which is affixed to the edge of the bag surrounding the upper opening thereof. The two journal axes of the two legs are contained in a single plane which is transverse with respect to the bag and they converge at a point above the exterior of the bag. As a result, during deployment of the two legs, they form a V, the spacing of the two legs increasing in correspondence with the extent of their deployment. The two legs are biased in the retracted or rest position, along the bag, by respective return springs which cause the automatic return of the legs to the rest position along the bag, as soon as the legs are freed, for example by lifting the bag.

The known stands having retractable legs for golf bags, of the type having individual springs for the automatic return of the legs, to the retracted position, along the bag, have, in the first place, the disadvantage that if, as a result of any movement of the bag, the contact of the lower ends of the legs with the ground ceases, these legs are automatically returned against the bag and consequently the stand formed by the two legs cannot maintain its deployed position in a permanent manner. Furthermore, the journal axes of the two legs are independent of one another, and the simultaneous deployment of these two legs requires providing a relatively complex mechanism which establishes a linkage between the two legs at points situated at a distance from the journal axes.

French Patent application No. 89 01185 in the name of applicant has sought to improve the linkage of the two legs by use of a coupling element of the cardan type which remedies the problem of accidental return and transmission, but the use of individual return springs on each leg adds an obvious mechanical complexity to the system.

SUMMARY OF THE INVENTION

The instant invention attempts to overcome the disadvantages noted above by providing a stand support structure which is particularly simple and compact and assures a firm maintenance of the legs of the support in the deployed position, and which furthermore avoids the use of a spring.

To this end, the support of the invention having retractable legs for a golf bag comprises an upper assembly constituted by the head of the bag, a base affixed to the head, two legs, each leg being journalled on the base around an axis so as to be movable between a retractable rest position and a deployed position, and an elastic system for maintaining the leg in the retracted position and in the deployed position, the elastic system being characterized by a movable support element acting on a deformable element.

The point of maximum compression of the support element on the deformable element is approximately the median point of the extent of the leg during their rotation from the rest to the deployed position, this being defined by an abutment system of the base.

The two legs are preferably connected to one another by a coupling element to allow for the transmission of the movement of one of the legs to the other.

BRIEF DESCRIPTION OF THE DRAWINGS

The invention will now be described by way of non-limiting example only, of one embodiment of the present invention, with reference to the annexed drawings in which:

FIG. 3 is a planar view, with partial breakaway, of the stand in the rest position;

FIG. 4 is a vertical cross-sectional view, on a larger scale, along line I—I of FIG. 3 during the beginning of rotation of the leg to its deployed position;

FIG. 4*a* is a simplified vertical cross-sectional view along line II—II of FIG. 3 during the retracted position of the leg;

FIG. 4*b* is a simplified vertical cross-sectional view along line II—II of FIG. 3 during the deployed position of the leg in abutment on the base;

FIG. 4*c* is a partial view, in cross-section and on a larger scale of FIG. 3, along line II—II during the retracted position of the leg in abutment according to the preferred embodiment of the invention;

FIG. 5 is a front view of the front of the head of the leg;

FIG. 6 is a side view of the head of the leg shown in FIG. 5;

FIG. 7 is a perspective view extending behind the coupling element attached to one of the two heads of the stand, the other having been detached;

FIG. 11 is a perspective view extending to the rear of the coupling element according to another embodiment of the invention;

FIG. 12 is a side view of the leg according to the embodiment shown in FIG. 11;

FIG. 13 is a side view of the leg according to another embodiment;

DESCRIPTION OF PREFERRED EMBODIMENTS

Figure 1:
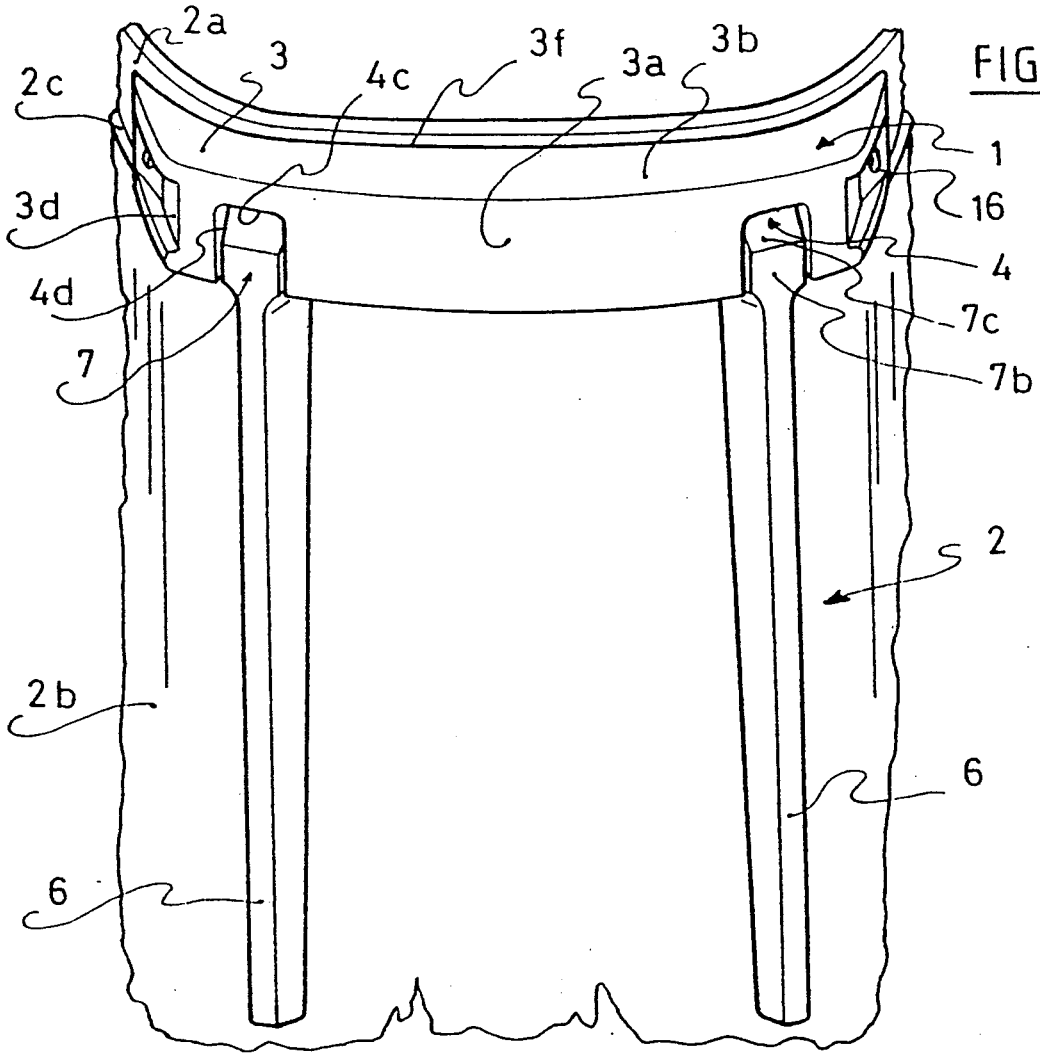
FIG. 1 is an elevational view, from the exterior, of a stand having retractable legs for a golf bag, in the rest position in which the legs extend the length of the upper portion of the bag.
Figure 2:
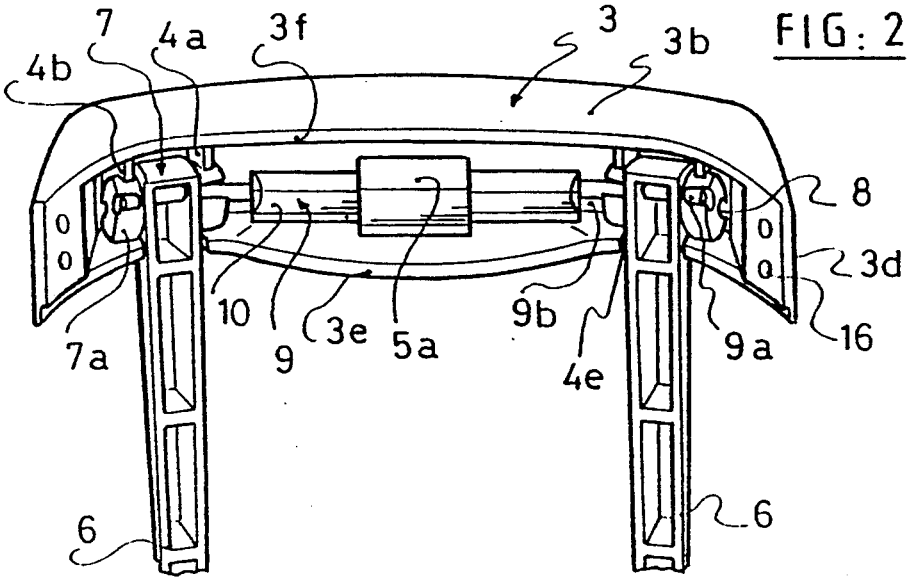
FIG. 2 is an elevational view of the stand of FIG. 1, seen from the interior, in the rest position.
Figure 8:
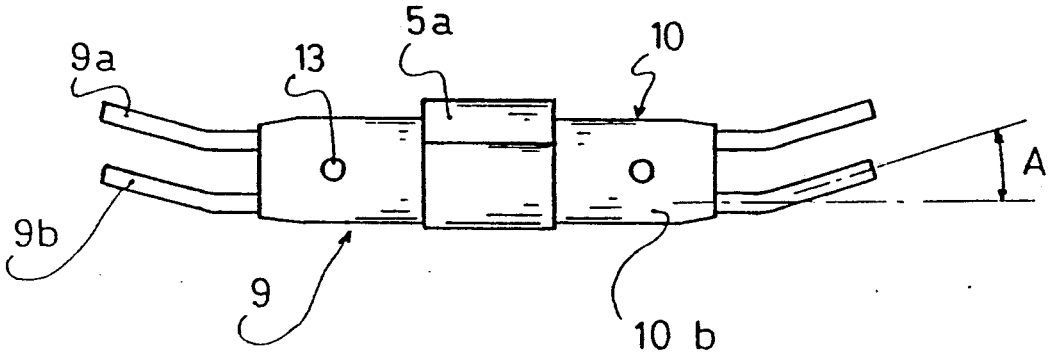
FIG. 8 is a view of the coupling element and the support element of FIG. 7 according to the preferred embodiment of the invention.
Figure 9:
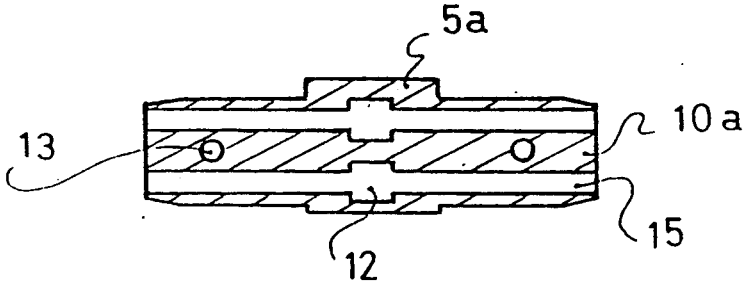
FIG. 9 is a view of a half support of the support shafts of the shaft of the coupling element of FIG. 8.
Figure 10:
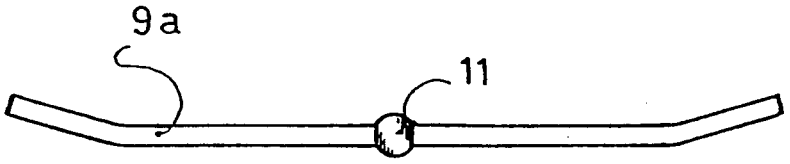
FIG. 10 is a view of one of the transmission shafts of the coupling element and support element of FIG. 8.
Figure 14:
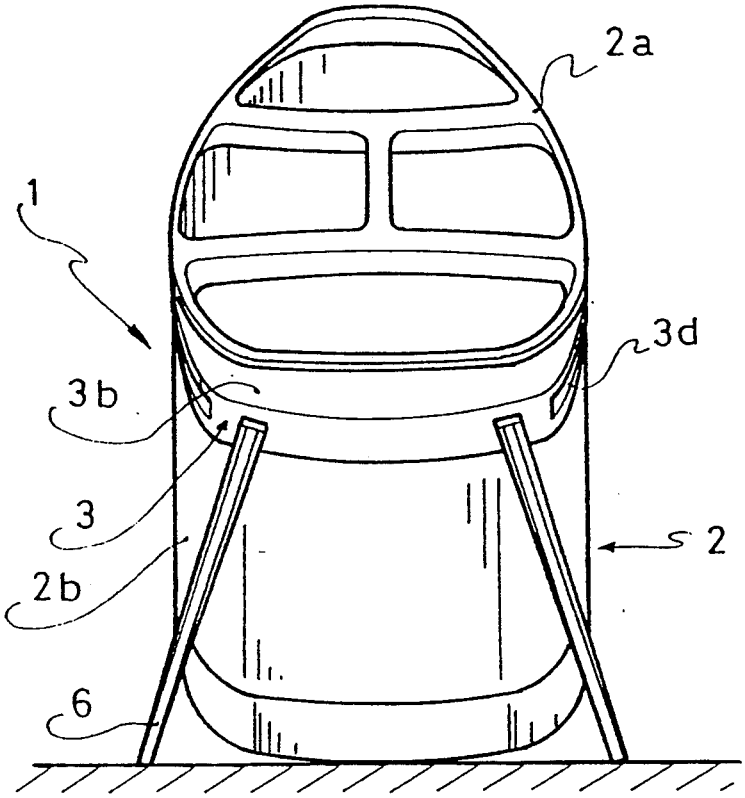
FIG. 14 is an elevational view of the stand in the deployed position maintaining the golf bag inclined with respect to the ground.
Figure 15:
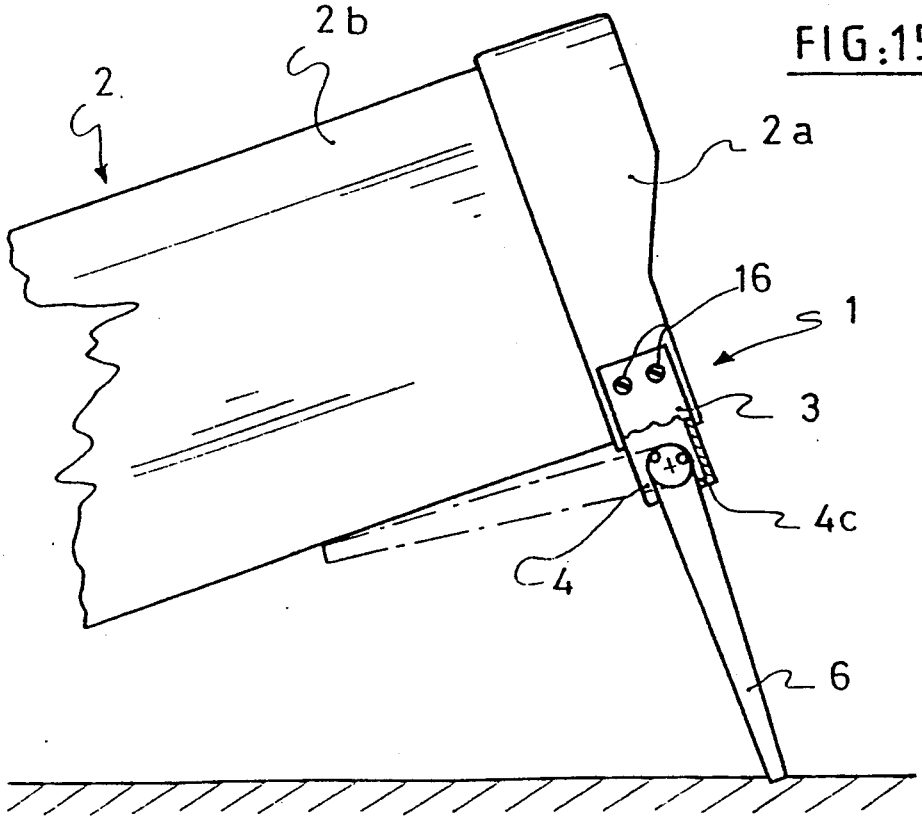
FIG. 15 is a side view, partially in cross-section, of the stand in its deployed position maintaining the golf bag in the inclined position.

The stand having retractable legs according to the invention which is designated in its entirety by reference 1 in the drawings is affixed to the exterior of the upper border 2*a* of the golf bag 2, the border which surrounds the upper opening of the bag through which pass the shafts of the clubs contained within the bag. This border is more commonly referred to as the head of the golf bag 2, as opposed to the body of the golf bag constituted by the lateral walls 2*b*.

Stand 1 comprises a base 3 made of a single piece, preferably formed out of molded plastic material, which comprises a frontal wall 3*a* whose camber is substantially the same as that of the front wall of the head 2*a* of the bag. From this wall there extends at each end two lateral sides 3*d* which are connected to head 2*a*. These two sides support the attachment means 16 of the rivet type, by soldering points or other means, and which serve to affix base 3 to the head of bag 2*a*. Base 3 likewise comprises an upper wall 3*b* and lower wall 3*c* whose edges 3*e* and 3*f* have a camber which is preferably identical to that of the wall of the head of the bag in a manner so as to be in contact therewith. At the desired placement of each of the legs on the base is positioned a window 4 which is cut on the front wall 3*a* and extending beneath the lower wall of base 3*c* so as to allow for a free pivoting of legs 6.

Support 1 comprises two retractable legs 6 which are adapted to be supported on the ground, at their lower ends, and which are journalled, at their upper ends, on base 3. For this purpose, each leg 6 is preferably molded out of a single piece of plastic material and ends at its upper end in a leg head adapted to cooperate with base 3.

As can be seen in FIG. 3, each head is provided with two coaxial lateral swivels 7*a* of a cylindrical shape centered around a fictional axis of rotation XX'. The axes XX' of the two legs 6 converge preferably towards the exterior at a point O (FIG. 3). Each coaxial swivel 7*a* is positioned between two semi-circular walls 4*a* and 4*b* of the base forming a rotational bearing.

All axial movement of the legs is furthermore limited by edges 4*e* of window 4 of lower wall 3*c* of the base in abutment against the lateral sides of the legs when they are in the folded position.

Likewise, in the deployed position, this movement is limited by the edges 4*d* of window 4 of frontal wall 3*a* of the base in abutment against the lateral walls of the legs.

In a like manner, in this position, the frontal surface 7*b* of the head of leg 7 abuts against the edge 4*c* of window 4 of the frontal window, thus limiting the pivoting of the leg in its deployed position to an angle which is preferably greater than or equal to 90 with respect to its retracted position. In the retracted position, the legs rest on the wall of the bag 2*b*, or if desired on a projection 2*c* of the head of the bag 2*a* as can be seen in FIG. 4*c*.

In one preferred embodiment, so as to allow for the passage during rotation of the heads of the legs across the upper edges of the window, a bevel 7*c* is formed on the frontal surface 7*b* of the head. Likewise, a bevel 7*d* of the rear surface of the head allows for the free passage in rotation without contact with the upper border of the bag 2 (FIGS. 5 and 6).

Each head of leg 7 is traversed laterally from one end to the other by two guidance holes 8 of small diameter in which are engaged two transmission shafts, front and rear, 9*a* and 9*b*, which are parallel and which form a portion of the coupling element 9. The ideal placement of the holes 8 can easily be determined by one of ordinary skill in the art. In the non-limiting embodiment of the present invention, the holes 8 are off axis with respect to swivels 7*a*, as can be seen in FIGS. 6 and 7.

Each transmission shaft 9*a* or 9*b*, preferably made of metal, is bent at each end at an angle A corresponding to the angle formed between the axis XX' and the longitudinal axis of the shafts (not shown) which is equivalent to the corresponding angle substantially to the angular displacement of each of the legs between a vertical rest position and an inclined deployed position. This angle A is likewise the angle of orientation of the windows 4 along an axis I—I with respect to the axis II—II (shown in FIG. 3) perpendicular to the frontal surface 3*a* of the base at its middle.

The legs/coupling element assembly constitutes a semi-rigid assembly. In effect, the association of the two transmission shafts allows no degree of liberty of rotation of one of the legs with respect to the other. In summary, as described previously, the legs can pivot from the angle A to their retracted vertical rest position to their deployed inclined position and vice versa; the shafts 9*a* and 9*b* being mounted to rotate freely and to slide in the guidance holes 8 and thus serve in the role of a cardan type system.

In this embodiment, the transmission 9*a* and 9*b* are maintained in parallel in a shaft support 10 provided with longitudinal bores 15 whose diameter is slightly greater than that of the shafts and allows for their rotation. It is furthermore preferable to provide for the manufacture of the support of the shaft out of two half-supports 10*a* and 10*b* which are identical and made out of hard molded plastic material for example.

So as to improve the operation of the leg/coupling element assembly and more precisely to limit the longitudinal displacement of the transmission shafts, a median cutout 11 in each shaft 9*a* and 9*b* is formed and cooperates with the cylindrical cavity 12 provided along the longitudinal bores 15 of the shaft support 10. The two half-supports 10*a* and 10*b* are assembled by any appropriate linkage means 13, e.g., riveting, gluing, welding, etc.

In the preferred embodiment, the rotation of the legs biases an elastic system constituted by a support element 5*a* affixed to the shaft support 10. This element 5*a* includes a cylindrical bulge out of the cam type as can be seen clearly in FIG. 7. The elastic system is constituted on the other hand by a deformable elastic element 5 which, in the context of the embodiment of FIG. 4, is constituted by the head portion of bag 2*a* in contact with the support element 5*a*. The shaft support 10, the support element 5*a* and the deformable element 5*b* constituting the elastic system 5 are preferably formed out of plastic material by molding or any other means. One of ordinary skill in the art is able to select the plastic material having satisfactory elasticity properties.

One can provide for affixing a metallic contact plate 14 on the deformable element 5*b* in a manner so as to facilitate the sliding and limit the wear of the contact elements.

The principle of operation of the leg stand according to the invention is simple.

In the folded position, as shown in position 4*a*, the legs are substantially parallel and maintained in abutment by a return force F1 having an application point P1 corresponding to the contact point on the deformable element creating a lever arm positioned at a distance d1 above axis XX' of rotation of the legs and thus generating a moment C1 in the direction of retraction of the legs.

When one desires to rest the golf bag on the ground in the inclined position, it is necessary to pull only one or the other of the two legs 6 towards the exterior so as to bring it to a position which is substantially perpendicular to the bag 2. The rotational movement of the leg which is seized is transmitted to the other leg by means of the transmission shafts of the coupling element. The deployment movement of the legs of the support occurs at the beginning of the creation of a moment opposing the return moment C1 which translates into a progressive increase of the compression force of the deformable element on the support element until there is reached a point of maximum compression corresponding to the contact with the tangent point of the support element on the deformable base.

Once this point of resistance has been passed, the deformation action is reversed and the deformable compressed elastic element serves the role of a spring which is triggered to bias the leg and to make it pass automatically into the deployed position. In this position, each leg is abutted against the base and it becomes substantially perpendicular to the border of the golf bag, preferably greater than 90°, so as to improve the stability. As can be seen in FIG. 4*b*, a return force F2, whose point of application P2 is positioned at the point of contact of the support element and the deformable element creates a lever arm positioned at a distance d2 under the axis X—X', and generates a return moment C2 which tends to maintain the leg in its deployed position in abutment against the base.

It is seen from the description above that the stand 1 is formed very simply, essentially with elements of plastic materials, preferably molded and that all of the elements of the journal apparatus and of the linkage apparatus are seated and protected in base 3.

Generally, the present invention can be modified in numerous ways without going beyond the spirit of the invention. For example, as is seen in FIGS. 11 and 12, one can imagine that support element 5*a* is disassociated on each of the heads of the stand and is independent from the coupling element 9.

In a like manner, the number of transmission elements 9*a* and 9*b* is by no means limiting.

As a result, one can avoid bending the shafts and maintaining transmissions shafts at an axis XX' passing through the center of heads 7 of the legs causing no spacing of the legs with respect to one another during deployment.

The upper assembly can also constitute the base 3 and the head of bag 2*a* may be formed molding out of a single piece.

Finally, and in particular, the deformation element may be different than what has been discussed until this point. For example, this can be an internal wall of base 3 which deforms under the action of support element 5*a* to the extent that the material selected for this element is more deformable than the material of the head of the bag.

It is also contemplated that the movable support element be the deformable element in this case, the two elements being one and the same, as can be seen in FIG. 13.

Although the invention has been described with respect to particular means, materials, and embodiments, it is to be understood that the invention is not limited to the particulars disclosed and extends to all equivalents within the scope of the claims.

What is claimed is:

1. A golf bag stand having retractable legs comprising an upper assembly including a bag head, a base affixed to said bag head, two legs, each leg being journalled on said base for movement about an axis so as to be moveable between two positions, said positions including a retracted rest position and a deployed position, an elastic system for maintaining said legs in the retracted rest position and in the deployed position, wherein said elastic system comprises a support element acting on a deformable element, said two legs being connected to one another by a coupling element, said legs being journalled around rotational axes which converge at a point, wherein said coupling element comprises at least two rigid transmission shafts which are parallel to one another and are connected to guidance holes in the upper ends of respective said legs.

2. The stand according to claim 1, wherein said guidance holes are positioned so as to be off-set with respect to a respective rotational axis of the legs.

3. The stand according to claim 2, wherein said rigid shafts are bent at each end at an angle.

4. The stand according to claim 3, wherein said rigid shafts are maintained parallel and in free rotation in a shaft support.

5. The stand according to claim 4, wherein said shaft support comprises two complementary half supports.

6. The stand according to claim 5, wherein said base and the head of the golf bag form an upper assembly molded from a single element.

7. The stand according to claim 5, wherein said base is an independent element to be affixed to the head of the golf bag.

8. The stand according to claim 1, wherein said base and the head of the gold bag form an upper assembly molded from a single element.

9. The stand according to claim 1, wherein said base is an independent element to be affixed to the head of the golf bag.

10. The stand according to claim 9, wherein said deformable element is a portion of said coupling element.

11. The stand according to claim 9, wherein said deformable element comprises at least a portion of said upper assembly.

12. The stand according to claim 11, wherein said deformable element is a portion of the head of the golf bag.

13. The stand according to claim 11, wherein said deformable element is a portion of said base.

14. The stand according to claim 11, wherein said support element comprises a portion which is affixed to each of said legs.

15. The stand according to claim 11, wherein said support element comprises a portion affixed to the coupling element.

16. The stand according to claim 1, wherein at least one portion of said upper assembly of said bag comprises abutments on which said legs rest in the retracted position and in the deployed position.

17. The stand according to claim 16, wherein said base comprises an upper wall which comprises an abutment on which said legs rest in the deployed position.

18. The stand according to claim 16, at least one of the lateral walls, the head of the golf bag, or the base, comprises the abutment on which said legs rest in the retracted position.

19. The stand according to claim 1, wherein each leg comprises a head from which extends on both sides thereof, two substantially identical coaxial swivels which are centered around an axis, and each cooperating in rotation on a substantially semi-circular internal wall of the base, thereby forming a rotational bearing.

20. The stand according to claim 19, wherein said legs are substantially identical.

21. The stand according to claim 20, wherein said legs are made from molded plastic.

22. The stand according to claim 1, wherein said base comprises a frontal wall whose camber radius is substantially the same as that of the frontal wall of the bag head, and from which extend, at each end, two lateral sides which join the head of the bag.

23. The stand according to claim 22, wherein said base comprises an upper and lower wall whose edges have a camber radius which is substantially identical to that of the wall of the bag head.

24. The stand according to claim 23, wherein said base includes a window whose front wall extends above said lower wall so as to allow free rotational movement of the legs.

25. The stand according to claim 1, wherein said base and the bag head are formed from plastic material.

26. The stand according to claim 1, and further comprising a golf bag.

27. The stand according to claim 1, wherein said legs are substantially identical.

* * * * *